United States Patent [19]

Zapf

[11] 4,272,142

[45] Jun. 9, 1981

[54] JUMPER CABLE

[75] Inventor: Richard L. Zapf, Des Moines, Iowa

[73] Assignees: Milton Brown; Laurence L. Anderson; Leonard Smith; David Belin, all of Des Moines, Iowa ; part interest to each

[21] Appl. No.: 84,619

[22] Filed: Oct. 15, 1979

[51] Int. Cl.[3] ..... H01R 11/22

[52] U.S. Cl. ..... 339/29 B; 320/25; 324/133; 339/113 L

[58] Field of Search ..... 339/10, 28, 29 R, 29 B, 339/113 R, 113 L; 320/2, 25, 26; 324/133

[56] References Cited

U.S. PATENT DOCUMENTS

| | | | |
|---|---|---|---|
| 775,732 | 11/1904 | Pape | 324/133 |
| 2,474,407 | 6/1949 | Todd et al. | 339/113 L |
| 3,259,754 | 7/1966 | Matheson | 320/25 |
| 4,079,304 | 3/1978 | Brandenburg | 339/10 |
| 4,163,134 | 7/1979 | Budrose | 339/29 B |

*Primary Examiner*—Neil Abrams

*Attorney, Agent, or Firm*—Zarley, McKee, Thomte, Voorhees & Sease

[57] ABSTRACT

A jumper cable comprised of first and second electrical cable means which each have a pair of electrical connector clamps on one end thereof. An electrical coupling is positioned on the other end of the two electrical cable means with the connectors adapted to be secured to each other at approximately the midpoint between the clamps. A polarity indicator circuit is located within each connector and is comprised of diodes and separate and differently colored lights to visually verify that the appropriate clamps have been secured to the battery being charged. An alternate form of the invention utilizes an audible sound means within the connectors to provide a sound signal if the clamps are not properly secured to the battery terminals.

6 Claims, 6 Drawing Figures

JUMPER CABLE

BACKGROUND OF THE INVENTION

This invention pertains to jumper cables utilized to permit one vehicle with a strong battery to provide electrical energy to the weakened battery of a second vehicle. Jumper or booster cables have long been used to permit one vehicle to start another when one of the vehicles has a battery which has lost its charge. This activity is quite dangerous because it invites the possibility that the batteries themselves will explode. If the positive terminals of the two batteries and the negative terminals of the two batteries are not correspondingly interconnected, considerable damage can result to both the batteries and the jumper cables. Furthermore, the sparks which can result through connecting the conventional clamps of existing battery cables can ignite fumes in the vicinity of the batteries to cause fire and/or explosions. This is particularly true when jumper cables are connected to the batteries in boats where gaseous fumes often collect in the confined space around the battery and the boat engines.

SUMMARY OF THE INVENTION

This invention involves a jumper cable device which removes the operator from the dangerous environment adjacent the battery and permits the jumper cables to be finally operatively connected at a point midway between the clamp elements which are secured to the respective batteries involved. Further, the device of this invention gives the operator a visual indication of whether or not the clamps of the jumper cable have been connected to the proper terminals of the battery. These objectives are accomplished by providing two cable segments which have clamp elements adapted to be secured to the battery terminals in conventional manner. The cable elements are connected together by their opposite ends so that when the two batteries are ultimately secured together in operative condition, the operator is not standing adjacent one of the batteries, but is at the midpoint of the coupled jumper cable. Light elements are located in the connectors to advise the operator as to whether or not the clamps on the cable ends have been secured to the proper battery terminals. An alternate form of the invention provides an audible signal means in lieu of the visual light elements to provide the same result. The use of this invention avoids the presence of sparks when the clamps are secured to the battery terminals.

DETAILED DESCRIPTION OF THE INVENTION

Figure 1:
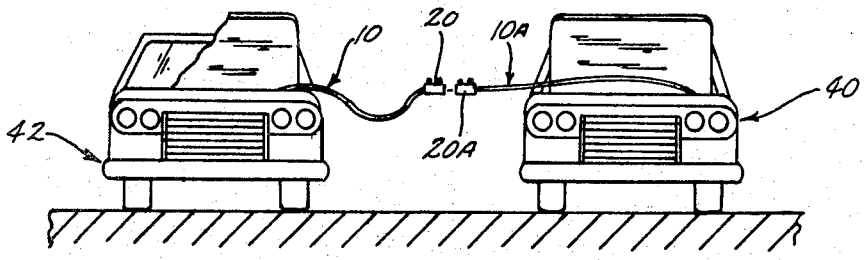
FIG. 1 is a front elevational view of two vehicles which are about to be interconnected by the jumper cable of this invention.
Figure 2:
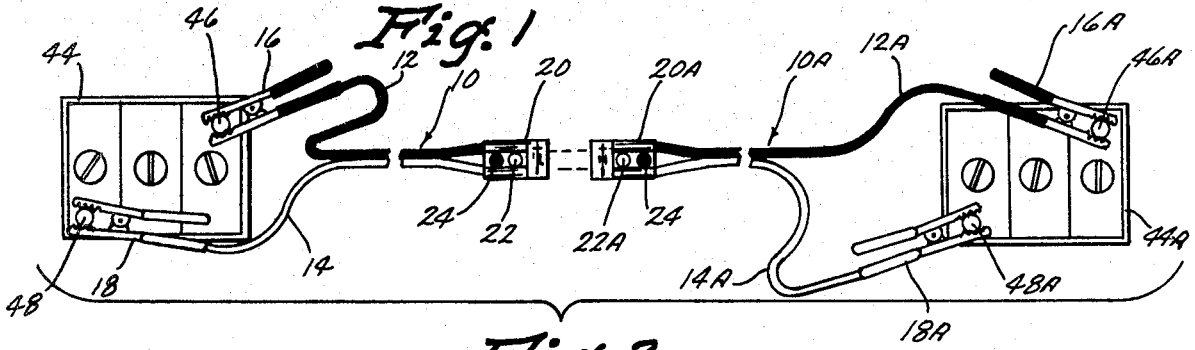
FIG. 2 is a schematic plan view at an enlarged scale of two batteries about to be coupled.
Figure 3:
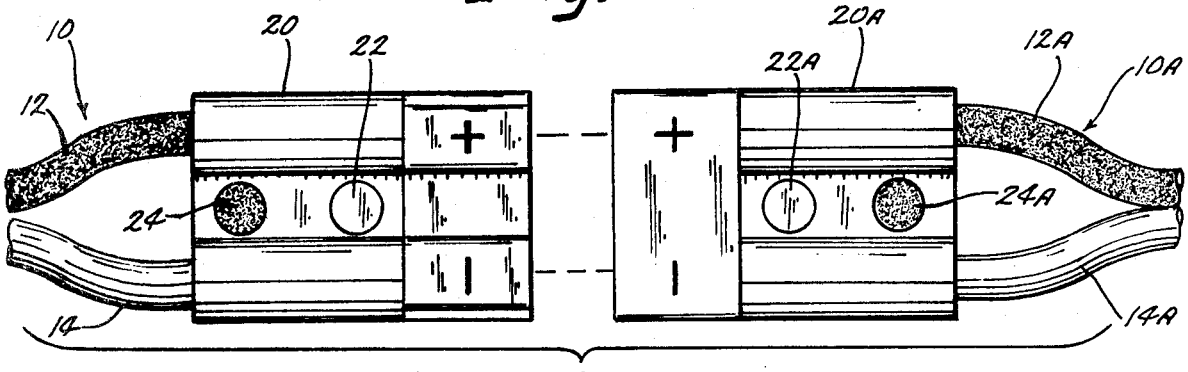
FIG. 3 is a plan view of the coupling elements of the jumper cable shown at an enlarged scale.
Figure 4:
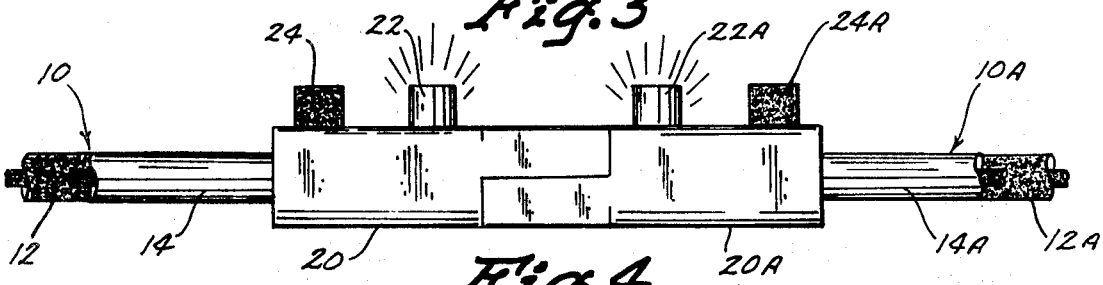
FIG. 4 is an elevational view of the coupler elements of FIG. 3 and shown in coupled condition.

The jumper cable of this invention is comprised of cable segments 10 and 10A. Cable 10 and its related components will be described hereafter, it being understood that cable segment 10A will have similar components identified by similar numbers followed by the letter "A". Cable segment 10 includes insulated positive cable element 12 and insulated negative cable element 14. Conventional terminal clamp 16 is secured to one end of cable element 12 and conventional terminal clamp 18 is secured to the end of cable element 14. Cable elements 12 and 14 are connected at their opposite ends in a conventional coupling 20 which has been modified as will be described hereinafter. Coupling 20 has been modified to provide a green light 22 and a red light 24 to visually indicate to the operator if the cable elements 12 and 14 have been properly connected to the battery terminals of corresponding polarity.

Figure 5:
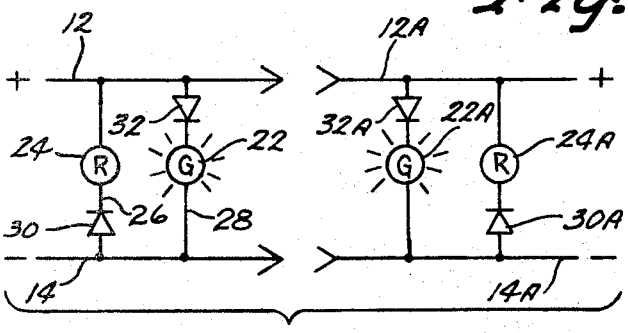
FIG. 5 is a schematic wiring diagram of the connectors of FIGS. 3 and 4.

As shown in FIG. 5, leads 26 and 28 are imposed across cable elements 12 and 14. Diode 30 is imposed in lead 26 between red light 24 and negative cable element 14. Similarly, diode 32 is imposed in lead 28 between green light 22 and positive cable element 12.

Figure 6:
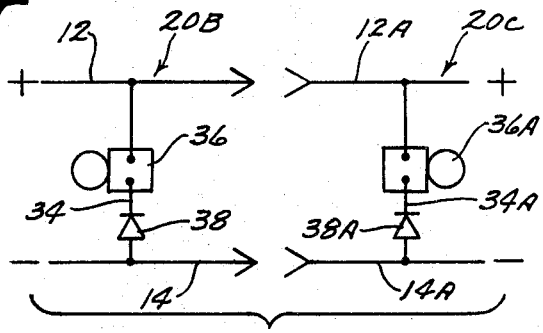
FIG. 6 is a schematic wiring diagram of an alternate form of the invention utilizing an audible signal means.

With reference to the alternate form of the invention shown in FIG. 6, a lead 34 is imposed between cable elements 12 and 14. Electrical buzzer element 36 is imposed in lead 34 and diode 38 is imposed in lead 34 between the buzzer element 36 and negative cable element 14. The numerals 20B and 20C have been used to denote the couplings of FIG. 6. The components of couplings 20B and 20C are identical and similar numerals have been used to identify the components thereof, except that "A" follows the numerals of coupling 20C.

The numeral 40 denotes a vehicle with a dead or low battery, and the numeral 42 denotes a vehicle with a charged battery. Vehicle 42 has battery 44 with positive terminal 46 and negative terminal 48. Vehicle 40 has battery 44A with positive terminal 46A and negative terminal 48A. When vehicle 42 is used to start the engine of vehicle 40, the clamps 16 and 18 of cable segment 10 are connected to the positive and negative terminals 46 and 48, respectively, of battery 44. Diode 32 permits current to flow through green light 22 to negative cable element 14, and the light 22 will be illuminated to advise the operator that the clamps have been connected to the proper terminals. Diode 30 prevents any flow of current through red light 24 to negative cable element 14. If the operator inadvertently connected cable element 14 to the positive terminal 46 of battery 44, and the cable element 12 to the negative terminal, diode 30 would permit red light 24 to be illuminated and green light 22 would not be illuminated. The red light would advise the operator that the error in terminal connections had taken place.

Cable segment 10A is similarly connected to dead battery 44A. Even if battery 44A is substantially drained of power, it will still illuminate the low voltage lights 22A and 24A in the manner described above in regard to lights 22 and 24. It should be noted that before couplings 20 and 20A are secured together, no sparks will be created as the separate cable segments 10 and 10A are connected to the respective batteries.

The couplings 20 and 20A are conventional except for the circuitry of FIG. 5, and will not permit connection unless the polarity thereof is correct. Thus, after the ends of cable segments 12 and 14 have been properly secured to the batteries, the only possible connection of the couplings 20 and 20A will provide the correct polarity between battery terminals. The audible buzzer of FIG. 6 will perform the same function as red light 24 if the cable segments are improperly connected to the batteries.

By locating couplings 20 and 20A at approximately the midpoint of the cable length, the operator is removed from the danger zone of the batteries and is thus relatively safe from explosion or fire. Further, since no sparks can be generated while the cable segments are connected to the batteries, the operator is safe even as the cable clamps are attached to the battery terminals.

When the stalled vehicle is safely started, couplings 20 and 20A are disconnected, and the clamps are removed from the battery terminals.

Thus, it is seen that this invention will accomplish at least all of its objectives.

What is claimed is:

1. A jumper cable device, comprising, a first electrical cable means having opposite ends, a pair of electrical connector clamps on one end of said first electrical cable means, an electrical coupling on the other end of said first electrical cable means, a second electrical means having opposite ends, a pair of electrical connector clamps on one end of said second electrical cable means, an electrical coupling on the other end of said electrical cable means, each cable means being comprised of positive and negative cable elements, electrical circuit means electrically connecting said cable elements within said couplings, polarity signal means imposed in said circuit means, a diode in said circuit means permitting flow of current in only one direction through said polarity signal means from one of said cable elements whereby the flow of current through said polarity signal means is indicative of the polarity of the clamps and cable elements associated therewith, said electrical couplings adapted to be secured directly together to effect electrical connection between said first and second electrical cable means, said electrical couplings having positive and negative terminals electrically connected to the positive and negative cable elements, respectively, of each cable means, and means on said couplings permitting the interconnection of said positive terminals together and permitting the interconnection of said negative terminals together, and preventing the interconnection of said positive and negative terminals.

2. The device of claim 1 wherein said electrical connector clamps are secured to the electrical circuit of separate vehicles, and said electrical couplings are secured together at a point between said vehicles.

3. The device of claim 1, wherein said polarity indicator device is an audible signal means.

4. The device of claim 1 wherein said polarity signal means comprises a light element and further comprising a second light element imposed in said circuit means, and a second diode permitting flow of current in only one direction through said second light element from the other of said cable elements.

5. A jumper cable device, comprising first and second battery electrical connector clamps, first and second cables electrically secured by one of their ends to said first and second clamps, respectively, a first electrical coupling electrically secured to the other ends of said first and second cables, third and fourth battery electrical connector clamps, third and fourth cables electrically secured by one of their ends to said third and fourth clamps, respectively, a second electrical coupling electrically secured to the other ends of said third and fourth cables, said first and second couplings adapted to be physically and electrically coupled and uncoupled to permit the selective electrical connection between said first and third cables, and between said second and fourth cables, and physical means on said first and second couplings to prevent the coupling thereof to connect said first cable to said fourth cable, or to connect said second cable to said first cable, said first and third cables being comprised of positive cable means and said second and fourth cables being comprised of negative cable means, first electrical circuit means electrically connecting said first and second cable means within said first coupling;

second electrical circuit means electrically connecting said third and fourth cable means within said second coupling;

first and second signal means imposed in said first and second circuit means, respectively, a first diode imposed in said first circuit means for permitting flow of current in only one direction through said first signal means from one of said first and second cables;

a second diode imposed in said second circuit means for permitting flow of current in only one direction through said second signal means from one of said third and fourth cables.

6. A cable device according to claim 5 comprising third and fourth signal means imposed in said first and second circuit means, respectively, third and fourth diodes being in said first and second circuit means, respectively, said third diode permitting current to flow through said third signal means only in a direction opposite to the direction of current flow permitted through said first signal means, said fourth diode permitting current to flow through said fourth signal means only in a direction opposite to the direction of current flow permitted through said second signal means.

* * * * *

UNITED STATES PATENT AND TRADEMARK OFFICE

CERTIFICATE OF CORRECTION

PATENT NO. : 4,272,142

DATED : June 9, 1981

INVENTOR(S) : Richard L. Zapf

It is certified that error appears in the above-identified patent and that said Letters Patent are hereby corrected as shown below:

Claim 1, column 3, line 26, after "electrical" insert --cable--.

Claim 1, column 3, line 29, after "said" insert --second--.

Coaim 5, column 4, line 28, change "first" to --third--.

Signed and Sealed this

*Eighth* Day of *April 1986*

[SEAL]

*Attest:*

DONALD J. QUIGG

*Attesting Officer*

*Commissioner of Patents and Trademarks*